US006669157B1

(12) United States Patent
Willin et al.

(10) Patent No.: US 6,669,157 B1
(45) Date of Patent: Dec. 30, 2003

(54) BOX HOLDER DEVICE

(76) Inventors: Patrick D. Willin, 1852 Pentas Ct., Carlsbad, CA (US) 92009; Stephanie L. Willin, 1852 Pentas Ct., Carlsbad, CA (US) 92009

( * ) Notice: Subject to any disclaimer, the term of this patent is extended or adjusted under 35 U.S.C. 154(b) by 0 days.

(21) Appl. No.: 10/371,575

(22) Filed: Feb. 24, 2003

(51) Int. Cl.[7] ..... A47K 1/08
(52) U.S. Cl. ..... 248/311.2; D6/518; 248/905
(58) Field of Search ..... 248/311.2, 314, 248/905, 309.1, 346.01, 346.03, 346.04; 224/572, 483, 277; 206/409; D6/518, 566

(56) References Cited

U.S. PATENT DOCUMENTS

| | | | | |
|---|---|---|---|---|
| 2,263,856 | A | 11/1941 | Tolley | 220/18 |
| D187,388 | S | 3/1960 | Lum | D52/2 |
| 3,258,238 | A | 6/1966 | Grafton | 248/311.2 |
| 3,288,416 | A | 11/1966 | Franklin | 248/311.2 |
| D238,838 | S | 2/1976 | Vrignaud | D23/2 |
| 4,094,416 | A | 6/1978 | Smith | 211/71 |
| 4,411,374 | A | 10/1983 | Hotchkiss | 211/63 |
| D276,389 | S | 11/1984 | Fellhoelter | D6/552 |
| D278,295 | S | 4/1985 | Thompson | D6/518 |
| D284,721 | S | 7/1986 | Carter | D6/518 |
| 4,696,448 | A | 9/1987 | Mazloom et al. | 248/311.2 |
| D293,182 | S | 12/1987 | Carter | D6/518 |
| D298,396 | S | 11/1988 | Gallego | D6/518 |
| 4,844,293 | A | 7/1989 | McLaughlin | 221/34 |
| 4,889,376 | A | 12/1989 | Nagy | 294/33 |
| 4,967,988 | A | * 11/1990 | Nguyen | 248/150 |
| D364,298 | S | 11/1995 | Phifer | D6/515 |
| D371,708 | S | 7/1996 | Haley et al. | D6/518 |
| D374,360 | S | 10/1996 | Angermeir | D6/518 |
| 5,573,216 | A | 11/1996 | Kuroda | 248/316.7 |
| D389,682 | S | 1/1998 | Gene | D6/518 |
| 5,823,497 | A | 10/1998 | Weatherhead | 248/316.7 |
| D437,167 | S | 2/2001 | Hardaway | D6/570 |

* cited by examiner

*Primary Examiner*—Ramon O. Ramirez
(74) *Attorney, Agent, or Firm*—Christopher J. Whewell

(57) ABSTRACT

A holder for boxes which may in some cases contain a plurality of disposable consumer items that are retrieved by a user on a single-use basis, such as facial tissues or latex or PVC rubber gloves. The box holder is mountable on a flat surface such as a wall or tabletop, and provides a convenient storage holder to contain such boxes while enabling the user to grasp the desired item from within the box with a single hand. Use of a box holder saves valuable countertop space while providing a rigid mounting means for a contained box and its contents.

10 Claims, 5 Drawing Sheets

BOX HOLDER DEVICE

TECHNICAL FIELD

This invention relates to articles useful for mounting items to a fixed surface such as a wall or tabletop. More particularly, it relates to a device adapted to hold a box and its contents in a fixed location desired by the user of items contained within such a box. The present invention is particularly well-suited for holding boxes of disposable items including boxes of latex gloves and facial tissues in a location which makes their access convenient to a user of such disposable items.

BACKGROUND

Many articles of commerce are provided by their manufacturers in boxes, wherein the boxes contain one or more features which enable the user of items contained within the box to conveniently remove a single item from the box without disturbing the remaining contents of the box. One well-known example of such provision by manufacturer's is the common box of facial tissue, which enables the consumer to grasp a single facial tissue for use while leaving the remaining tissues in the box accessible for later retrieval on an as-needed basis. Similarly, manufacturers of disposable gloves provide their products in a box which enables the end user to remove gloves from the box on an as-needed basis without disturbing the gloves remaining within the box.

In the medical field, doctors and other care providers employ latex and gloves of other polymeric composition for various purposes, but generally to protect either the doctor or patient from becoming contaminated in a medical procedure such as an examination, or during a surgery. Since the efficient use of space is a primary concern for those whose work duties entail the use of several different pieces of equipment and wares, tabletop surface area within, for example, a medical examination room is an important commodity which needs to be used judiciously. It is true in general that whenever possible, items should be stored in out of the way locations, to increase efficiency of the various procedures and operations as a whole.

In this regard, it is beneficial to locate latex gloves, tissues, and the like in out of the way locations. Prior art practice has found that locating boxes of items on walls is a judicious choice in the effort to conserve tabletop space and increase the efficiency of operations. Thus, one finds that various workers having similar concerns have contrived a variety of devices capable of holding boxes, which include the following US Patent documents, all of which are incorporated herein by reference thereto in their entirety: U.S. Pat. Nos. 2,263,856; D 276,389; 3,258,238; D 278,295; 3,288,416; D284,721; 4,696,448; D 293,182; 4,889,376; D 298,396; 5,573,216; D371,708; 5,823,497; D 374,360; D 187,388; D 389,682; D 238,838; and D437,167.

We have found it to be desirable for such box holding devices that they should enable the rapid positioning of the box and its contents within the holding device in a minimal amount of time. We have also found that it is desirable for such box holding devices that they should rigidly hold the box and its contents in position so that the box is not pulled out of the holder by virtue of the action of a person grasping one of the contained items from the box. We have also found that it is desirable for such box holding devices that they should enable the rapid removal of an empty box easily and in a minimal amount of time. We have also found that it is desirable for such box holding devices that they should be configured so that they may be placed alongside one another, with a minimal amount of wasted surface area in between them, so as to conserve space. We have also found that it is desirable for such box holding devices that they should be easy to affix to any desired surface. We have also found it is desirable for such box holding devices that they should not conceal the front, side, or end of the box being held, thus rendering the exterior of the box to be highly visible to users of the boxes' contents. We have also found that it is desirable for such box holding devices that they should be relatively simple in construction so as to reduce their cost to enable persons who use boxed items to enjoy the benefits of the use of such box holders by virtue of their reduced cost. We have also found that it is desirable for such box holding devices that they should be constructed from a single piece which is produced by an injection molding process. While various workers have produced the articles described in the aforesaid US Patent documents, none thus far have provided a device which simultaneously incorporates all of the aforesaid desirable characteristics into a single box holder. The present invention, on the other hand, succeeds in that it does provide in a single box holder all of the aforesaid features. Thus, we believe that our invention succeeds where previous workers have failed, in this regard. These and other benefits of the box holder we now provide will become readily apparent to one of ordinary skill in the art after reading and understanding the present specification and the claims appended hereto.

SUMMARY OF THE INVENTION

The present invention provides a device useful for holding and mounting a box containing useful articles to a flat surface in a way which enables a person to remove and replace the box. A device according to the invention comprises a substantially-rectangularly-shaped, base portion having a flat bottom surface adapted to contact a wall, a flat top surface which is adapted to contact a box disposed within the device, two long sides, and two short sides, wherein the base portion comprises a plurality of mounting holes disposed therethrough. There is a risor rib centrally disposed on the top surface of the base portion, wherein the risor rib protrudes upwardly from the flat top surface. There is a backstop affixed to the top surface of the base portion at one of the short sides, wherein the backstop protrudes upwardly from the flat top surface on the base portion an effective amount to stop the travel of a box that is inserted into the device. There are a plurality of side bars disposed along each of the long sides, the side bars including a first end portion which is attached to the base portion at the top surface, and a second end portion, and wherein the side bars protrude upwardly from the flat top surface on the base portion. There is a flat prong portion disposed at the second end portion of each of the side bars, wherein the prong portion extends towards the interior of the base portion and in a direction that is substantially perpendicular to the length dimension of the side bars.

In another embodiment, the present invention provides a device as described above which further comprises a plurality of depressions along one of the long sides, and a plurality of protrusions along the remaining long side which does not have depressions, wherein the protrusions are spaced apart from one another the same distance that the depressions are spaced from one another. According to one form of the invention there is a plurality of cutout holes disposed through the base portion, adjacent to the side bars, wherein the number of the cutout holes is equivalent to the number of the side bars. According to the invention the useful articles contained in the box which is held by a device according to the invention are selected from the group consisting of: facial tissues and rubber gloves.

DETAILED DESCRIPTION

Figure 1:
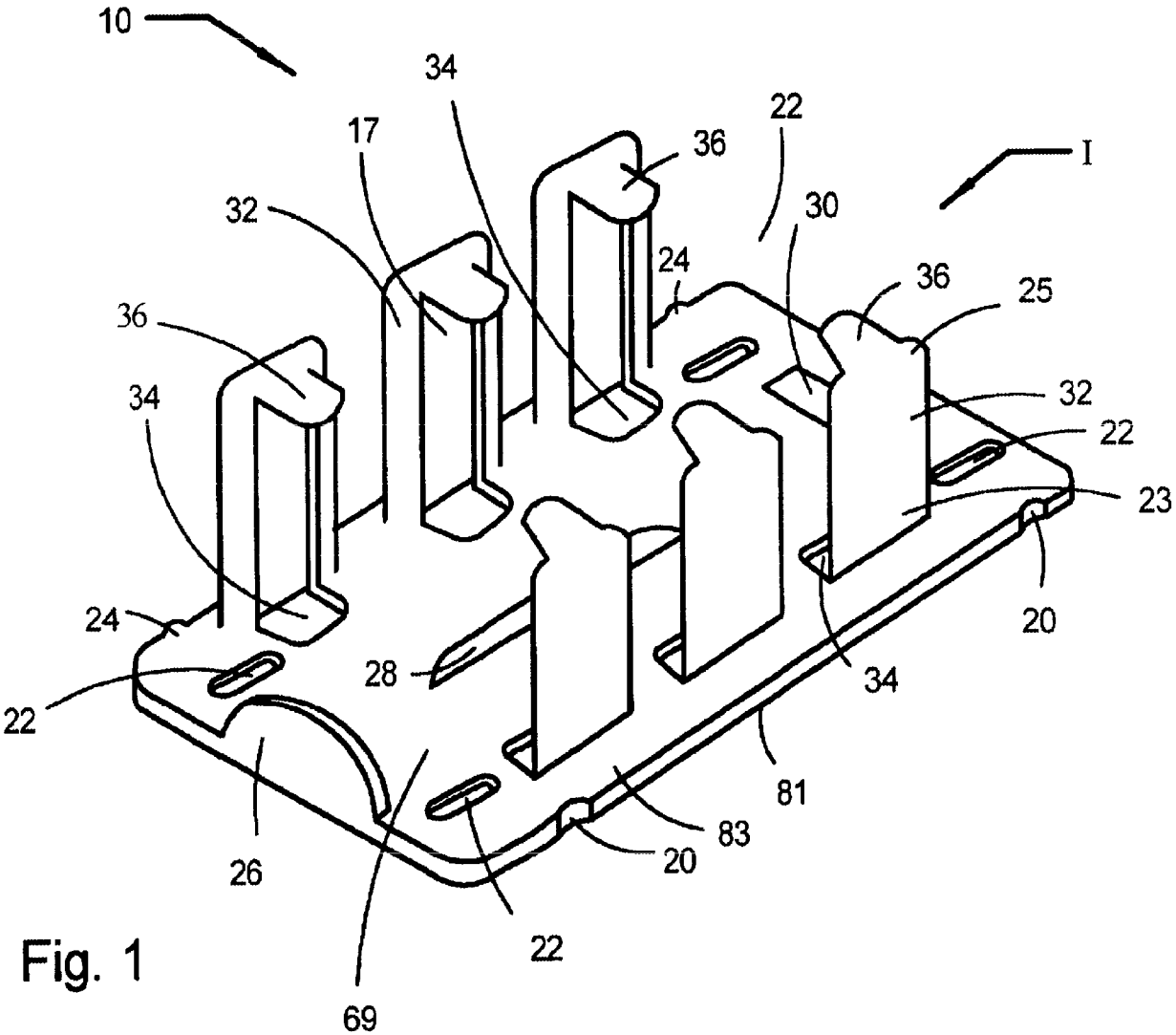
FIG. 1 is a perspective view of a box holder device according to the invention.

Referring to the drawings and initially to FIG. 1 there is shown a device 10 according to the invention in perspective view. Such device 10 includes a substantially-rectangular base portion 69 having two long sides and two short sides, which also has a flat top surface 83 which is adapted to contact a box that is disposed within the device during its normal use. There is also a bottom surface 81, which is flat and is adapted to contact a wall to which the device 10 according to the invention is mounted during its normal use. The base portion 69 includes a plurality of holes 22 disposed through it which are useful for mounting the device 10 to a wall or other flat surface using conventional fasteners such as screws, anchor bolts, or other known means for attaching articles to walls which are known in the art.

There is a risor rib 28 which is centrally located on the flat top surface 83, whose purpose is to contact the bottom surface of a box which is inserted into the device 10 according to the invention in order to provide an interference fit to such box by exerting a slight pressure on the bottom of the box being held, which slightly deforms the box, which box is generally of a cardboard or other cellulose-based fiber construction, in one popular employment of a device 10 according to the invention. According to one preferred embodiment of the invention, the top of the risor rib 28 (which extends upward from the planar surface of the base portion 69) is disposed at a location which is between 10% and 20% of the distance from the planar surface of the base portion 69 to the prong portion 36, including every percentage therebetween. According to a preferred embodiment, the top of the risor rib 28 is disposed at a location which is about 14% of the distance from the planar surface of the base portion 69 to the prong portion 36

There is a backstop 26 which is affixed to the top surface 83 of the base portion 69 a one of the short sides, wherein the backstop protrudes upwardly from the flat top surface 83 of the base portion 69 an effective amount to stop the travel of a box that is inserted into the device 10. Thus, in normal use, the end of the box will be in contact with the backstop portion 26.

Figure 5:
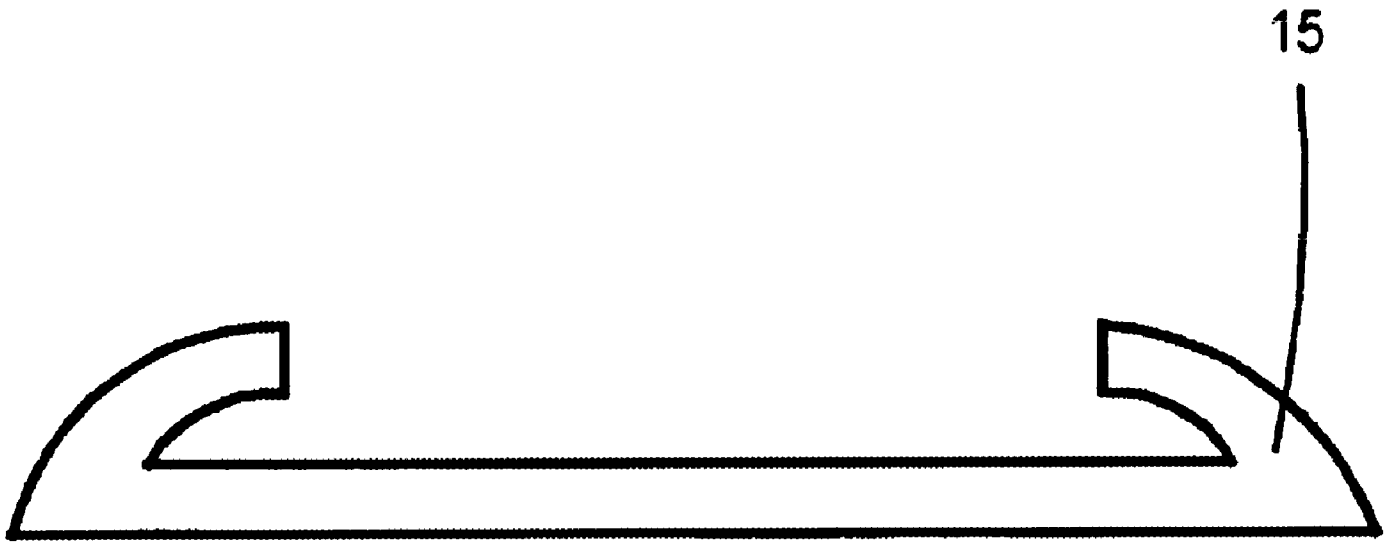
FIG. 5 is a cross section view of a side bar element according to a preferred form of the invention taken along the length of the side bar.

There are a plurality of side bars 32 each of which are disposed along each of the long sides. The side bars 32 include a first end portion 23 which is attached to the base portion 69 at the flat top surface 83, and a second end portion 25. The side bars protrude upwardly from the flat top surface 83 of the base portion 69. According to one form of the invention, the side bars 32 include a concave surface 17, as viewed from above (FIG. 5) in their interior.

At the second end portion 25 of each of the side bars 32 there is a flat prong portion 36, which prong portion extends in a direction towards the interior of the base portion. The direction of extension of the prong portions 36 is substantially perpendicular to the length dimension of the side bars 32. The intersection of the prong portion 36 with the side bars 32 forms an angle alpha (FIG. 2), which angle may be any angle in the range of between about 80 to 100 degrees, with an angle of about 90 degrees being most preferable.

Figure 3:
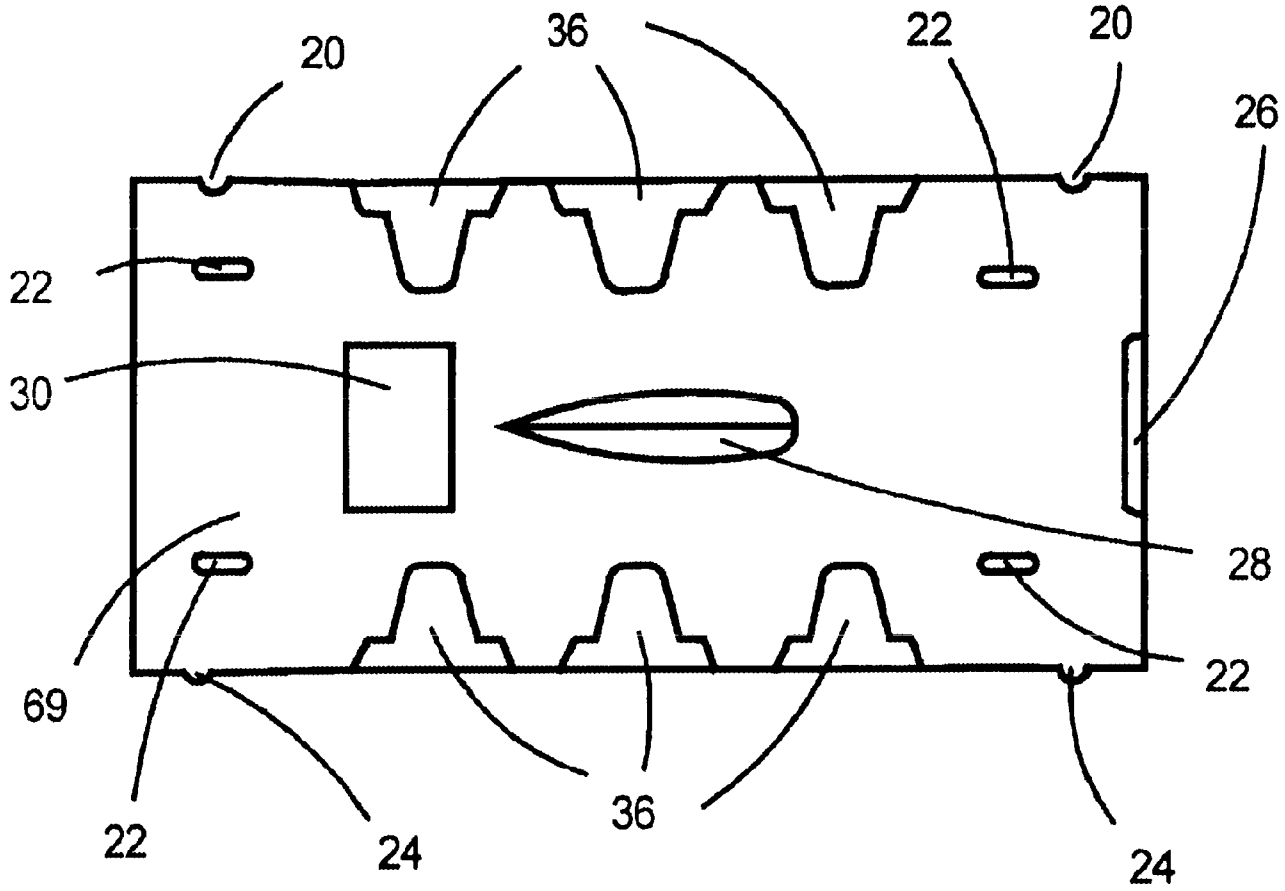
FIG. 3 is an overhead view of a device according to one form or the invention.

According to one preferred form of the invention, there are a plurality of depressions 20 along one of the long sides of the substantially-rectangularly shaped base portion 69, which are reminiscent of notches, but are preferably curved or concave in shape as viewed from above (FIG. 3). There are also a plurality of protrusions 24 disposed along the remaining long side of the substantially-rectangularly shaped base portion 69 which does not include depressions 20, wherein the protrusions are spaced apart from one another the same distance that the depressions are spaced from one another. Such feature enables side-by-side placement of two or more devices 10 according to the invention in an interlocking fashion, which saves space and provides an overall structure having more integrity.

According to one form of the invention, there are a plurality of cutout holes 34 which are disposed through the base portion adjacent to the side bars 34 on the side which is towards the interior of the base portion 69, for the purpose of reducing the amount of material used to make a device 10 according to the invention when the device 10 according to the invention is made from a single piece, as in the case when it is made by an injection molding process, which is most preferred. The cutout holes 34 also add an aesthetic effect to the appearance of the device 10 according to the invention.

In practice, when a box is to be inserted into a device 10 according to the invention, it is inserted from the end having no backstop, in a direction shown by I in FIG. 1. The box is pushed into the device until its end abuts the backstop portion 28.

Figure 2:
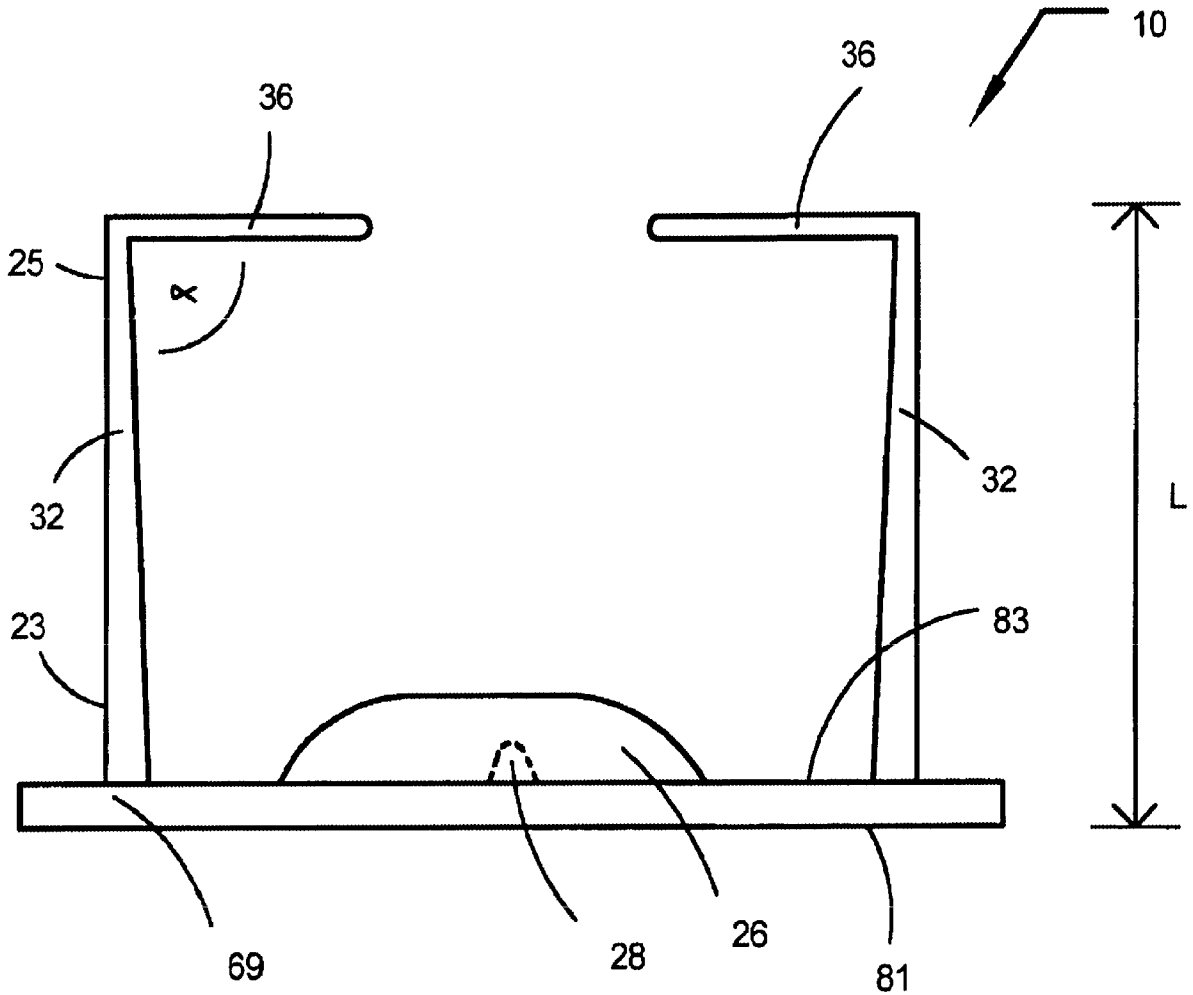
FIG. 2 is an end view of a device according to one form or the invention.

FIG. 2 shows an end view of a device 10 according to the present invention, and its various features including the base portion 69 having flat top surface 83 and flat bottom surface 81. The side bars 32 are shown having a first end portion 23 and second end portion 25, as well as the prong portions 36, as well as the angle alpha formed at their intersection. The backstop 26 is shown, as well as the risor rib 28. the length dimension L of the side bars 32 is also shown.

FIG. 3 shows a top view of a device 10 according to the present invention, and its various features including the base portion 69, mounting holes 22, risor rib 28, depressions 20, protrusions 24, prong portions 36, and backstop 26. Also shown in FIG. 3 is a recessed area 30, which is useful for affixing a tag or label which serves as an identifier. The recessed area 30 has a flat surface which is slightly recessed in the top surface 81 of the base portion 69.

Figure 4:
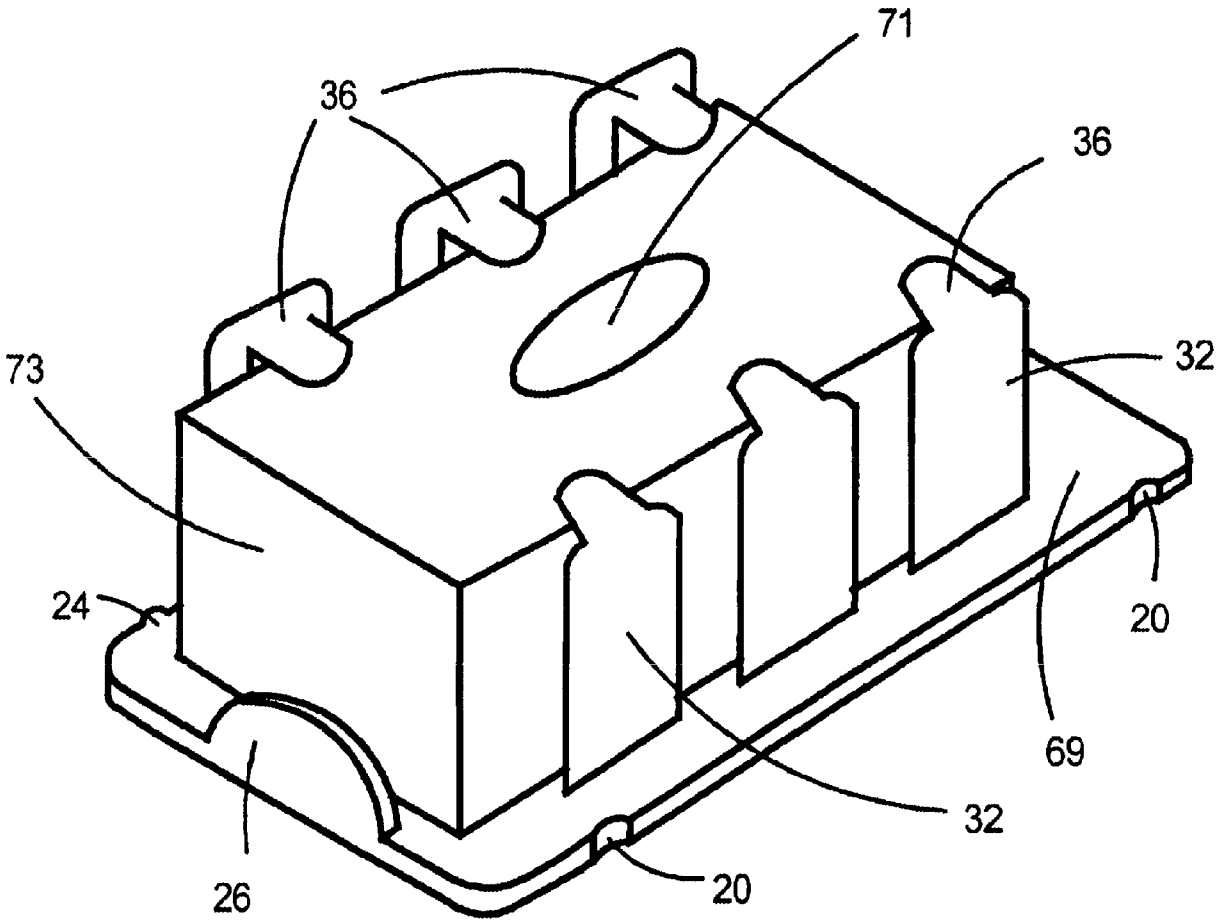
FIG. 4 is a perspective view of a device according to the invention in which a box is held.

FIG. 4 is a perspective view of a device according to the invention in which a box 73 is held, as in its normal use. The box 73 has an opening through which facial tissues or rubber gloves may be dispensed to the user. There is also shown the respective locations of the base portion 69, side bars 32, prong portions 36, depressions 20, protrusion 24, and backstop 26.

Although in the various figures the side bars 32 are shown as being inset slightly from the outer edge of the base portion 69, the present invention embraces embodiments wherein the side bars 32 are disposed to coincide with the outer edge of the base portion 69.

As regards the materials from which a device according to the present invention may be made, any material is suitable, with polymers being most preferred because the most preferable method of manufacturing a device 10 according to the invention is injection molding. Accordingly, all polymer resins known to be useful in injection molding are useful in producing a device 10 according to the invention, including without limitation thermoplastic resins selected from the group consisting of: polyethylene and polypropylene homopolymers or copolymers, SBS plastic, ABS plastic, PVC, CPVC, and thermoset resins as well.

Another advantage of the present invention is that many prior art devices do not take into account the visibility of the box which is being held by such box holding devices. In medical and dental settings, there are typically more than one type or size of glove being used, and the ability to see the size or type of glove (i.e., latex vs. non-latex, etc) is a great benefit of a device according to the present invention.

Consideration must be given to the fact that although this invention has been described and disclosed in relation to certain preferred embodiments, obvious equivalent modifications and alterations thereof will become apparent to one of ordinary skill in this art upon reading and understanding this specification and the claims appended hereto. Accordingly, the presently disclosed invention is intended to cover all such modifications and alterations, and is limited only by the scope of the claims which follow.

What is claimed is:

1. A device useful for holding and mounting a box containing useful articles to a flat surface in a way which enables a person to remove and replace said box, which device comprises:

a) a substantially-rectangularly-shaped, base portion having a flat bottom surface adapted to contact a wall, a flat top surface which is adapted to contact a box disposed within said device, two long sides, and two short sides, and at least one mounting hole disposed therethrough;

b) a risor rib disposed on said top surface of the base portion, wherein said risor rib protrudes upwardly from said flat top surface;

c) a backstop affixed to said top surface of said base portion at one of said short sides, wherein said backstop protrudes upwardly from said flat top surface on said base portion an effective amount to stop the travel of a box that is inserted into said device;

d) a plurality of side bars disposed along each of said long sides, said side bars including a first end portion which is attached to said base portion at said top surface, and a second end portion, and wherein said side bars protrude upwardly from said flat top surface on said base portion; and e) a flat prong portion disposed at the second end portion of each of said side bars, wherein said prong portion extends towards the interior of said base portion and in a direction that is substantially perpendicular to the length dimension of said side bars.

2. A device according to claim 1 and further comprising:

f) a plurality of depressions along one of said long sides; and g) a plurality of protrusions along the remaining long side which does not have depressions, wherein said protrusions are spaced apart from one another the same distance that said depressions are spaced from one another.

3. A device according to claim 1 further comprising: f) a plurality of cutout holes disposed through said base portion, adjacent to said side bars, wherein the number of said cutout holes is equivalent to the number of said side bars.

4. A device according to claim 3 further comprising:

g) a plurality of depressions along one of said long sides; and h) a plurality of protrusions along the remaining long side which does not have depressions, wherein said protrusions are spaced apart from one another the same distance that said depressions are spaced from one another.

5. A device according to claim 1 wherein said useful articles comprises an article selected from the group consisting of: facial tissues and rubber gloves.

6. A device according to claim 1 wherein the inner surface of said side bars is concave.

7. A device according to claim 1 wherein the top of the risor rib is disposed at a location which is between 10% and 20% of the distance from the flat top surface of the base portion to the prong portions, including every percentage therebetween.

8. A device according to claim 3 wherein the prong portions are identically contoured, as viewed from above, to match the contours of said cutout holes in said base portion.

9. A device according to claim 1 further comprising a box of useful articles selected from the group consisting of: gloves and facial tissues, wherein said box is disposed within the space defined by said side bars, said prongs, said flat top surface of said base portion, and said backstop, so as to form a box/holder combination.

10. A box/holder combination according to claim 9 wherein said risor rib is in contact with the bottom of said box of useful articles.

* * * * *